US005941154A

United States Patent [19]

Merten et al.

[11] Patent Number: 5,941,154

[45] **Date of Patent: *Aug. 24, 1999**

[54] GUIDE SHOE FOR A CUTTING MACHINE

[75] Inventors: Gerhard Merten; Frank Fischer, both of Lünen, Germany

[73] Assignee: DBT Deutsche Bergbau-Technik GmbH, Germany

[ * ] Notice: This patent is subject to a terminal disclaimer.

[21] Appl. No.: 08/905,603

[22] Filed: Aug. 4, 1997

[30] Foreign Application Priority Data

Aug. 20, 1996 [DE] Germany ..... 196 33 491

[51] Int. Cl.[6] ..... B26D 5/00

[52] U.S. Cl. ..... 83/823; 104/248

[58] Field of Search ..... 83/821, 823, 435, 83/455, 614; 104/248, 246, 242

[56] References Cited

U.S. PATENT DOCUMENTS

| | | | |
|---|---|---|---|
| 951,698 | 3/1910 | Poole | 104/248 |
| 1,289,653 | 12/1918 | Castano | 104/248 |
| 1,814,969 | 7/1931 | Schmeck | 104/248 |
| 3,080,826 | 3/1963 | Nelson et al. | 104/248 |
| 4,067,620 | 1/1978 | Lanfermann | 299/43 |
| 4,326,440 | 4/1982 | Harmant | 83/488 |
| 4,537,577 | 8/1985 | Sansome et al. | 104/248 |
| 4,718,349 | 1/1988 | Wahren | 104/165 |
| 4,943,120 | 7/1990 | Groger | 299/42 |
| 5,704,267 | 1/1998 | Merten et al. | 83/823 |

FOREIGN PATENT DOCUMENTS

| | | |
|---|---|---|
| 2523639 | 9/1983 | France . |
| 2530754 | 4/1979 | Germany . |
| 2646291 | 9/1980 | Germany . |
| 2925240 | 1/1981 | Germany . |
| 2938446 | 4/1981 | Germany . |
| 2552085 | 2/1988 | Germany . |

*Primary Examiner*—Rinaldi I. Rada
*Assistant Examiner*—T. Anthony Vaughn
*Attorney, Agent, or Firm*—Vickers, Daniels & Young

[57] ABSTRACT

The guide shoe according to the invention for cutting machines with a pintype drive has an insertion pocket in which a coupling piece engages from above, which coupling piece is arranged on a guide arm of the cutting machine and to which the guide shoe is attached so as to be pivotable by means of a transverse bolt which passes through the insertion pocket. In order also to allow the guide shoe to be pivotable about a vertical axis, the coupling piece is provided with an upright vertical journal which engages from below in a corresponding bearing hole on the guide arm. In this case, in a preferred embodiment, the bearing journal is decoupled from transverse forces which are transmitted between the guide arm and the guide shoe via a transverse-force piece arranged on the coupling piece.

19 Claims, 3 Drawing Sheets

FIG.2
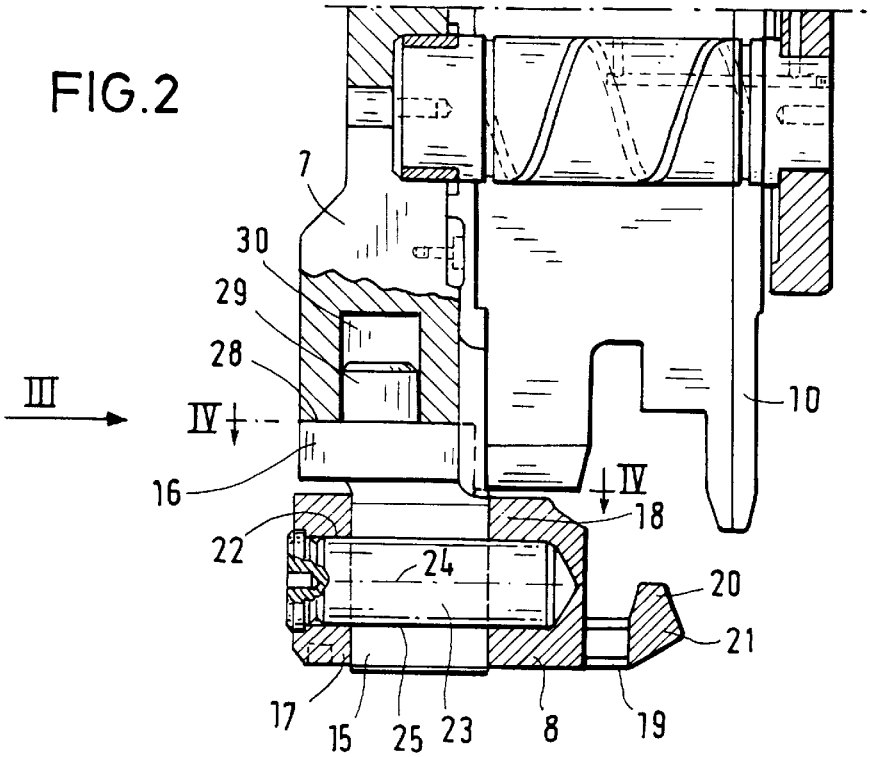
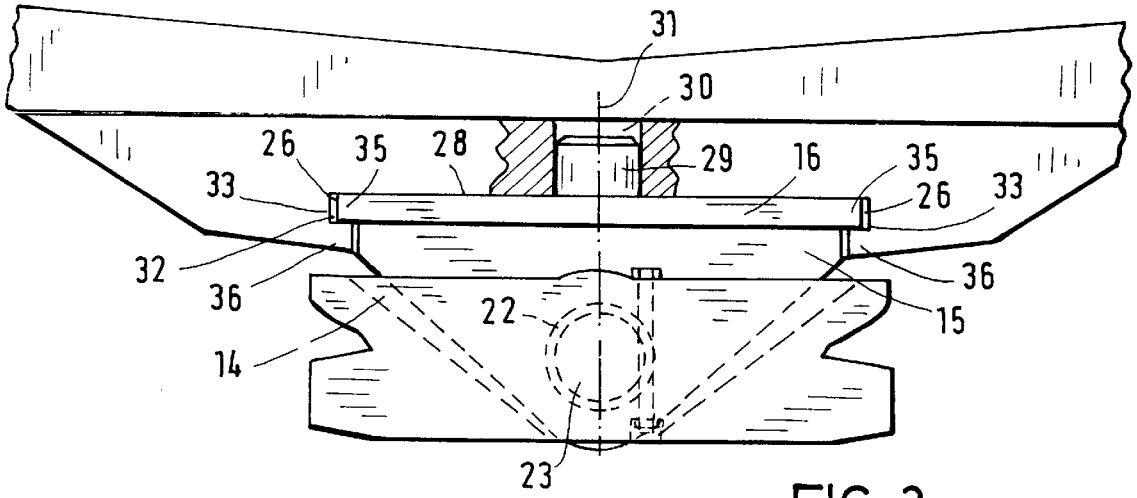
FIG. 3

GUIDE SHOE FOR A CUTTING MACHINE

FIELD OF THE INVENTION

The invention relates to a guide shoe for a cutting machine, especially for a drum shearer which is also often referred to as a coal auger, which cutting machine runs above a conveyor and can be moved along the conveyor by means of a pin-type drive, the guide shoe being of the type to be connected to a guide arm of the cutting machine so that it can pivot about a transverse bolt, and the guide shoe having a guide projection which interacts with a guide strip on the conveyor.

BACKGROUND OF THE INVENTION

As is well known, cutting machines often referred to as coal augers or drum shearers are used worldwide in mining operations for excavating coal seams. They are used in underground workings together with a conveyor, designed as a chain conveyor, which can be advanced in the direction of excavation and are designed in such a way that they straddle the conveyor in the manner of a portal with their machine body. In this case, the cutting machines are supported and guided on both sides of the conveyor on guide rails arranged on the conveyor.

The modern cutting machines are moved along the conveyor with the aid of a pin-type drive during their excavation run. In this case, it is usual to arrange a pin drive element on the side remote from the coal face, i.e. on the stowing side of the conveyor, which element comprises toothed or pin-type racks or preferably a pin drive chain. In this case, the cutting machine has at least one gearwheel or pin wheel which is driven by a drive and engages in the pin-type rack mounted on the conveyor or in the horizontal chain links of the pin drive chain (DE-C-25 30 754, DE-A-29 38 446, FR-C 2 523 639).

It is usual to guide the cutting machine on that side (generally the stowing side) of the conveyor where the pin drive element or the pin drive chain is located by means of guide shoes on guide strips which, in this case, are attached laterally to the conveyor, machine guiding in the vertical and lateral direction being brought about with the aid of the guide shoes. In this case, it is also known to attach the guide shoes to the cutting machine or to guide arms thereof by means of horizontal transverse bolts so that they can pivot up about the bolt to a limited extent, so that they are capable of adapting to the path of the conveyor which is usually not horizontal. In this case, guide shoes are used, for example, which engage around the pin-type racks from above and below approximately in the manner of a hook, and which are attached to the cutting machine or its machine body with spacing above the pin-type racks so as to be pivotable about the horizontal transverse bolts (DE-C-25 52 085, DE-C-26 26 291, DE-A-29 25 240). However, it is also known to attach bearing rails to the conveyor on the stowing side, in which rails the pin drive chain is disposed, and which at the same time form guide strips for the guide shoes (FR-C 2 523 639).

A disadvantage of these known arrangements is that, although the guide shoe, as a result of its pivotability about the transverse bolt, provides compensation when the floor is not flat, the guide shoe can nevertheless become clamped on the guide strip while the cutting machine is moving, if the guide strip does not extend precisely in a straight line, but assumes a slightly curved course, for example when advancing the individual conveyor pans of the conveyor. In this case, constraining forces may occur between the guide shoe and the guide strip, which forces are transmitted to the cutting machine and result in increased wear.

SUMMARY OF THE INVENTION

Starting from the abovementioned prior art, which is incorporated herein by reference, the invention is mainly based on the object of providing a guide shoe for cutting machines, e.g. rolling cutting machines, which permits secure and precise guiding of the cutting machine along the guide strip without any jamming or the like occurring in the process and thus ensuring both good vertical and good horizontal guiding of the cutting machine.

It is therefore proposed to make the guide shoe connectable to the guide arm so as to be rotatable or pivotable about a vertical axis. In this way, preferably a universal joint-type connection, provided by a combination of the transverse bolt and an additional vertical journal, is provided between the guide shoe and the guide arm.

The guide shoe can thus not only be pivoted about the transverse bolt about a horizontal axis, but pivoting about the vertical axis is additionally made possible, so that, in the event of a slightly curved course of the guide rail, for example when the conveyor pans of the conveyor do not lie in a straight line, the guide shoe can adapt to the said course, and no jamming occurs between the guide shoe and the guide strip. In this way, the wear of the parts can be reduced substantially.

It is particularly expedient if the vertical journal is arranged on an approximately plate-shaped coupling piece which is arranged in an insertion pocket on the guide shoe so as to be pivotable by means of the transverse bolt.

In this embodiment of the guide shoe in which the coupling piece is bounded circumferentially and at the bottom by wall parts of the insertion pocket, a good seat results as does reliable pivoting displacement of the guide shoe on the guide arm of the cutting machine both about the horizontal axis of the transverse bolt and about the vertical axis. This also enables the bolt joint for the transverse bolt, at the same time, be arranged at a particularly low level on the guide shoe, which results in particularly good and reliable guiding of the cutting machine by means of the guide shoes attached to it during cutting machine operation. For this purpose, the guide shoe furthermore preferably has, on its bottom, a preferably central bottom opening for the engagement of the coupling piece, thus making it possible for the joint connection for the transverse bolt to be arranged at a particularly low level.

A particularly advantageous refinement results if the coupling piece is provided with a transverse-force piece which engages in a cutout on the guide arm. Such a design results in the vertical journal only taking on the function of a hinge and not having to absorb any forces transversely to its axis of rotation, all of which forces are transmitted between the guide arm and the guide shoe by the transverse-force piece. The vertical journal can thus be dimensioned to be comparatively weak without this possibly leading to the journal becoming damaged or even broken off if the guide shoe in the guide strip bumps against an obstacle, such as, for example, a boulder, and thus inhibited briefly in its free movement.

On its end faces which receive transverse forces, the transverse-force piece is preferably designed to be approximately convex with a centre of curvature in the axis of the vertical journal. It can thus pivot freely in the cutout on the guide arm while always resting against the front and rear contact surfaces of the cutout in the direction of movement of the cutting machine, so that the force transmission via the transverse-force piece is always ensured irrespective of the angular position of the guide shoe in relation to the guide arm.

It is particularly advantageous if the transverse-force piece projects beyond the coupling piece at its end face, and holding webs arranged on the guide arm engage below the said transverse-force piece. The holding webs engaging below the transverse-force piece effectively prevent the guide shoe from dropping down out of the guide arm, and thus bring about a positive-locking connection of the two components, but without impeding the free pivotability of the vertical journal in the associated bearing hole on the guide arm.

The cutout for the transverse-force piece can be designed to be essentially rectangular, while the transverse-force piece has an approximately trapezoidal design which tapers in the direction of the end faces. With small dimensions of the guide arm and the transverse-force piece, this refinement ensures sufficient pivotability which usually does not need to be greater than 5 to 10°. On its contact faces facing the end faces of the transverse-force piece, the cutout may have a concave curvature with a radius of curvature which corresponds approximately to the radius of curvature of the end faces of the transverse-force piece. As a result, the transverse-force piece is always in flat contact with the guide arm in the cutout, irrespective of its angular position, so that the surface pressures between these two components is comparatively low.

A particularly advantageous refinement results if the cutout is designed to be open laterally to the direction of travel of the cutting machine. In such an arrangement, the guide shoe can be mounted on the guide arm in a particularly simple manner, in that, having been rotated through about 90° relative to its direction of travel, it is inserted from below with the vertical journal into the corresponding bearing hole on the guide arm and is then pivoted into its direction of travel, the holding webs engaging below the transverse-force piece and thus securing the guide shoe against dropping out.

The coupling piece can have a convexly curved shaped-out portion which, in the coupling state, is inserted into the bottom opening, and the inner surfaces of the parallel side walls of the insertion pocket can form vertically disposed flat contact surfaces for the plate-shaped coupling piece. In this case, the width of the insertion pocket is closely adapted to the width of the coupling piece, so that the latter has a good lateral support in the guide shoe, that is to say the coupling piece is mounted essentially without play on the transverse bolt, thus resulting in a good lateral support of the guide shoe on the guide arm. The guide shoe is preferably mounted on the guide arm with a pivoting restriction.

Further features and advantages of the invention emerge from the following description and the drawings in which an embodiment of the invention is explained in greater detail using an example.

BRIEF DESCRIPTION OF THE DRAWINGS

FIG. 2 shows, in a front view corresponding to FIG. 1, a guide shoe attached to a guide arm according to the invention;

FIG. 3 shows the object of FIG. 2 in a view along the line III—III and partially in section;

DETAILED DESCRIPTION OT THE EMBODIMENT

Figure 1:
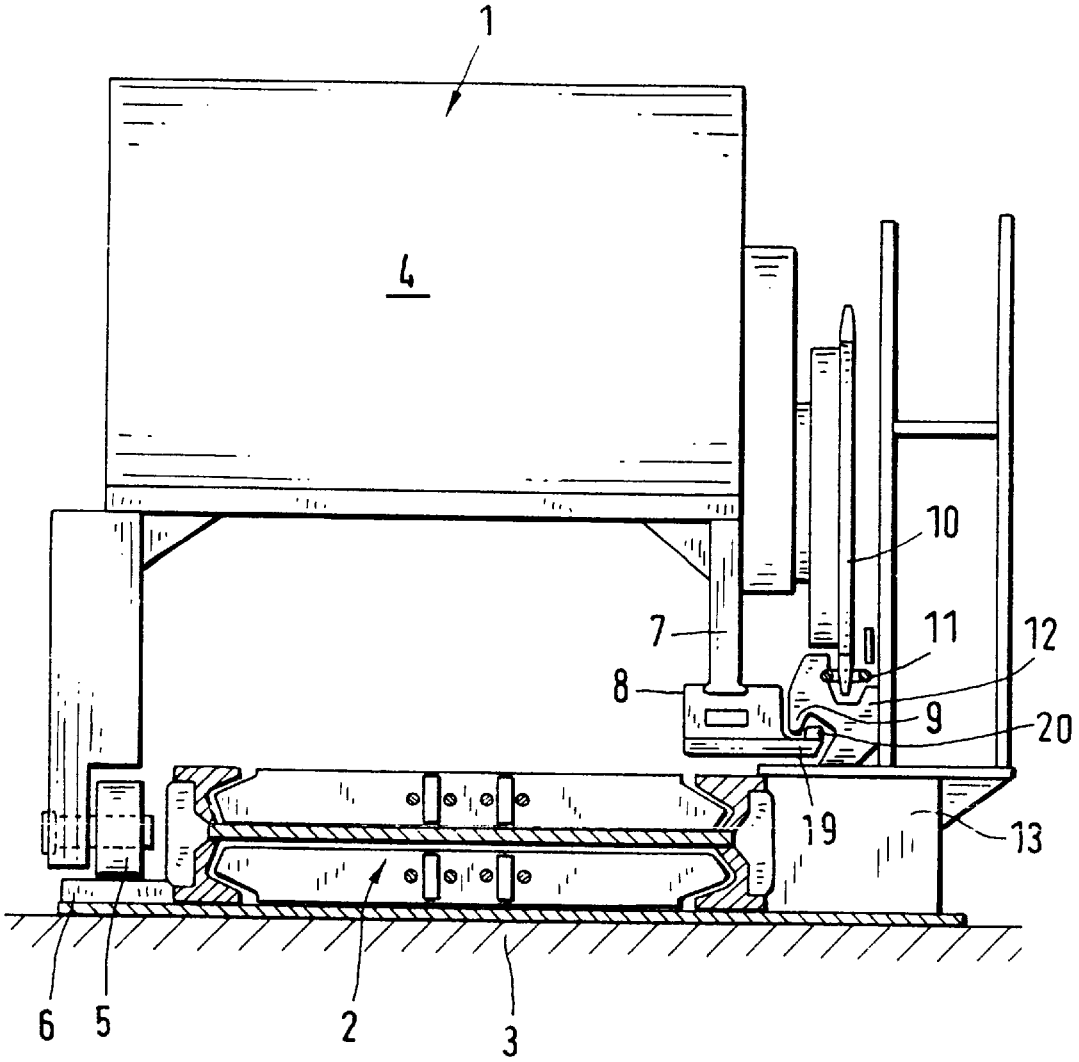
FIG. 1 shows, in a diagrammatic and simplified view in the longitudinal direction of the conveyor, a cutting machine generally of the type known with its guide and with a pin-type drive, the conveyor being shown in vertical section.

FIG. 1 shows a very diagrammatic overview drawing of a cutting machine system which is generally of the known type with a cutting machine 1 and a conveyor 2 which, in underground working, is arranged on the floor 3 in front of the coal face (not illustrated). Of the cutting machine 1, essentially only its machine body 4 is shown, which straddles the conveyor 2 in the manner of a portal and is supported on one side of the conveyor (coal face side) by means of running rollers 5 or else sliding runners on a running rail 6 which is fixedly arranged laterally on the conveyor 2. On the opposite side (stowing side) in the region of each of its two ends, the machine body 4 has a guide arm 7, to whose lower end a guide shoe 8 is pivotably attached, which is guided on a guide strip 9. On its machine body 4, the cutting machine 1 has a drive with at least one driven gearwheel or pin wheel 10 which meshes with a pin drive chain 11 mounted on a bearing rail 12. In the exemplary embodiment shown, the bearing rail 12 also forms the guide strip 9. It is fixedly arranged on brackets 13 which are attached to the conveyor 2 on the stowing side.

The conveyor 2 comprises in the usual way a chain conveyor whose conveying port is composed of individual conveying chutes or conveyor pans which are each connected to each other with slight vertical and horizontal articulation.

Numerous configurations of cutting machine systems of the general design described above or similar designs are known and have been in use for many years. The present invention lies in the design and arrangement of the guide shoes 8 of the cutting machine.

Figure 5:
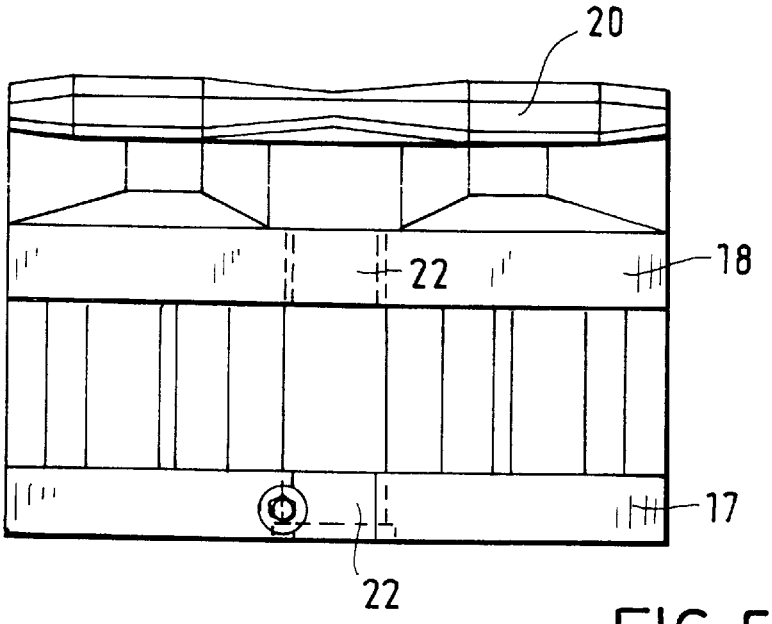
FIG. 5 shows the guide shoe in a plan view without a coupling piece.

As shown in FIGS. 2 and 5, the integrally designed guide shoe 8 has an approximately slot-like insertion pocket 14 which is open on the upper side of the guide shoe 8 for the engagement of a plate-shaped coupling piece 15 which is provided, at its upper end, with a transverse-force piece 16 which is arranged slightly offset and whose function will be described below. The insertion pocket 14 is bounded on its two longitudinal sides by mutually parallel side walls 17 and 18 of the guide shoe. It can seen, in particular in FIG. 2 that the inner surfaces of the two parallel side walls 17 and 18 of the guide shoe 8 are designed as vertically disposed flat surfaces which form contact surfaces for the plate-shaped coupling piece 15 whose side surfaces which face the inner surfaces of the side walls 17 and 18 are likewise designed as flat vertical surfaces. In this case, the width of the coupling piece 15 corresponds essentially to the inside width of the insertion pocket between the inner surfaces of the side walls 17 and 18, so that the coupling piece 15 is held in the insertion pocket 14 virtually without play apart from pivotability about an approximately horizontal axis.

Figure 4:
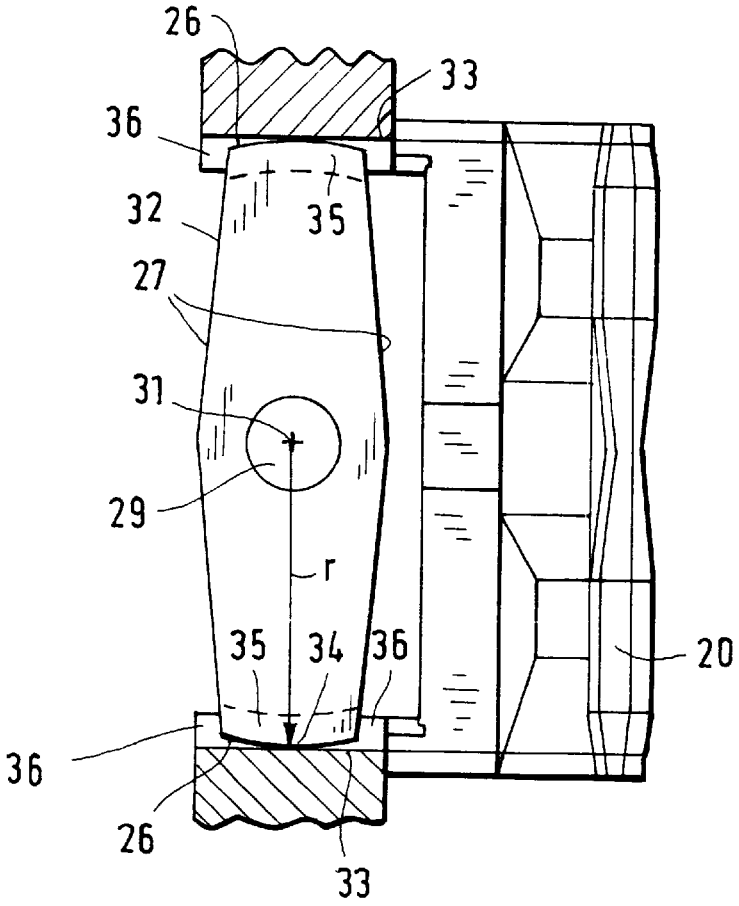
FIG. 4 shows the guide shoe according to the invention in a section along the line IV—IV of FIG. 2.

As shown in FIGS. 3 to 5, the guide shoe 8 is of symmetrical design relative to its vertical centre plane. Arranged on the outside of the inner side wall 18 is a fixed guide projection 19 which, as shown in FIGS. 4 and 5, extends over the entire length of the guide shoe 8 and is designed as a hook strip which is provided with an upright guide hook 20. As shown in FIG. 1, the hook strip 21 engages from below around the guide strip 9 which is fixedly arranged on the conveyor, the guide hook 20 engaging behind the guide strip 9 in a slot cutout, so that the cutting machine 1 is guided in the horizontal and vertical direction on the guide strip 9 by the guide shoes 8.

The parallel side walls 17 and 18 of the guide shoe 8 each have bolt holes 22 which are flush in the centre thereof and into which a horizontal transverse bolt 23 is inserted, whose bolt axis 24 runs transversely to the longitudinal direction of the conveyor 2 and accordingly transversely to the direction of travel of the cutting machine 1. The transverse bolt 23 inserted into the flush bolt holes 22 passes through a bolt hole 25 of the coupling piece 15 in the insertion pocket 14, as a result of which the guide shoe 8 is held on the coupling piece 15 so that it can be pivoted up to a limited extent about the transverse bolt 23.

As can best be seen in FIG. 2, the coupling piece 15 is integrally connected, at its upper end which protrudes out of the insertion pocket 14, to an approximately plate-shaped transverse-force piece 16 which is of approximately trapezoidal design in its plan view and has two narrow convexly curved end faces 26 extending transversely to the direction of travel of the cutting machine 1 and two longitudinal sides 27 which converge slightly towards the end faces 26. Arranged centrally on the upper side 28 of the transverse-force piece 16 is a vertical journal 29 which engages from below in a bearing hole 30 provided on the guide arm 7 and thus allows the entire guide shoe to pivot about an approximately vertical axis 31. In this case, the arrangement is such that, with the vertical journal 29 engaging in the bearing hole, the transverse-force piece 16 lies in a cutout 32 in the guide arm 7, the convexly curved end faces 26 resting against the front and rear narrow sides 33 of the cutout 32, as can be seen in particular in FIG. 4. As a result, the transverse forces transmitted from the guide shoe to the guide arm and vice versa in the direction of travel of the cutting machine 1 are transmitted via the transverse-force piece 16 and not by the pivoting journal 29 which is thus decoupled from these forces and will not be damaged even under high impact-type loading on the connection of the guide arm and guide shoe, for example by a boulder jammed in the guide rail.

In order to prevent the guide shoe 8 dropping down out of the guide arm 7, the transverse-force piece 16 projects at its end-face end regions 34 beyond the coupling piece 15 with edge beads 35 which are approximately square in section and is held on the guide arm by holding webs 36 which engage below the edge beads 35. Since the cutout 32 on the guide arm is designed to be laterally open, as emerges in particular from FIG. 4, the guide shoe can easily be mounted on the guide arm in that, having been rotated through about 90° in relation to its longitudinal direction, it is inserted with its vertical journal 29 into the bearing hole from below and is then rotated through about 90° into its operating position, the holding webs 36 engaging below the edge beads 35 and holding the guide shoe in a positive-locking manner.

It can be seen that, by means of the invention, adaptation of the guide shoe to the course of the guide rail 9 is not only possible in the vertical direction, that is to say in the case of an uneven floor 3, but the arrangement, which can also be pivoted about a vertical line, can also easily compensate for a curved course of the guide rail which occurs, for example, when advancing the individual conveying elements (conveyor pans).

The invention is not limited to the embodiment described and illustrated, but a large number of changes and modifications are conceivable without departing from the scope of the invention. For instance, the narrow sides 33 of the cutout 32 could thus likewise be of curved design, i.e. drawn in concavely with a radius of curvature which corresponds to the radius of curvature r of the end faces 26, so that the force-transmitting surface between these two components is enlarged and permissible surface pressures are not exceeded.

Having thus described the invention, it is claimed:

1. A guide shoe arrangement for a cutting machine which runs above a conveyor and can be moved along the conveyor using a pin-type drive, the cutting machine having a guide arm and the conveyor having a guide strip, the guide shoe arrangement comprising:

a guide shoe having a guide projection to interact with said guide strip of the conveyor; and a pivot arrangement;

the guide shoe being connectable to said guide arm of the cutting machine via said pivot arrangement, said pivot arrangement having first and second pivot axes, said first axis allowing rotation of said guide shoe relative to said guide arm about an axis transverse to said conveyor, said second axis being transverse to said first axis and transverse to said conveyor and allowing rotation of said guide shoe relative to said guide arm.

2. A guide shoe arrangement according to claim 1, said second axis comprising a vertical pivot which is a vertical journal corresponding to said second axis, said first axis being a transverse pivot which is a transverse bolt corresponding to said first axis, said vertical journal and said transverse bolt in combination providing a universal joint-type connection between the guide shoe and said guide arm.

3. A guide shoe arrangement according to claim 2 comprising a coupling member, wherein said guide shoe has an insertion pocket, said coupling member is engaged in said insertion pocket, said transverse bolt rotatably connects said coupling member to said guide shoe, and said vertical journal projects from said coupling member.

4. A guide shoe arrangement according to claim 3, wherein the guide shoe is shaped to define an opening in the bottom of said insertion pocket, said coupling member protruding through said opening when engaged in said insertion pocket.

5. A guide shoe arrangement according to claim 3, wherein said coupling member is provided with a transverse-force member to engage a cut-out in said guide arm.

6. A guide shoe arrangement according to claim 5, wherein said transverse-force member has end faces for transmitting force to said guide arm, and said end faces are generally convex with a centre of curvature in the rotational axis of said vertical journal.

7. A guide shoe arrangement according to claim 6, wherein said end faces of said transverse-force member project beyond said coupling member.

8. A guide shoe arrangement according to claim 6, wherein said transverse force member is generally trapezoidal in shape and tapers towards said end faces.

9. A guide shoe arrangement according to claim 4, wherein said coupling member comprises a convexly curved portion, and when said coupling member is engaged in said insertion pocket said convexly curved portion protudes through said opening defined in the bottom of said insertion pocket.

10. A guide shoe arrangement according to claim 3, wherein said insertion pocket is defined by opposed mutually parallel side walls, said side walls being vertical and providing flat contact surfaces to abut said coupling member.

11. A guide arrangement for a cutting machine which runs above a conveyor and can be moved along the conveyor using a pin-type drive, the conveyor having a guide strip, the guide arrangement comprising:

a guide arm of the cutting machine;

a guide shoe connectable to said guide arm, the guide shoe having a guide projection to interact with said guide strip of the conveyor; and a pivot arrangement via which said guide shoe is connected to said guide arm;

said pivot arrangement having two pivot axes to allow rotation of said guide shoe relative to said guide arm about an axis transverse and horizontal to said conveyor, and rotation of said guide shoe relative to said guide arm about a vertical pivot axis.

12. A guide arrangement according to claim 11, comprising a vertical pivot which is a vertical journal corresponding to said vertical pivot axis, and a transverse pivot which is a transverse bolt corresponding to said transverse pivot axis, said vertical journal and said transverse bolt in combination providing a universal joint-type connection between the guide shoe and said guide arm.

13. A guide arrangement according to claim 12, comprising a coupling member, wherein said guide shoe has an insertion pocket, said coupling member is engaged in said insertion pocket, said transverse bolt rotatably connects said coupling member to said guide shoe, and said vertical journal projects from said coupling member.

14. A guide arrangement according to claim 13, wherein said coupling member is provided with a transverse-force member to engage a cut-out in said guide arm.

15. A guide arrangement according to claim 14, wherein said transverse-force member has end faces for transmitting force to said guide arm, and said end faces are generally convex with a centre of curvature in the rotational axis of said vertical journal.

16. A guide arrangement according to claim 15, wherein said end faces of said transverse-force member project beyond said coupling member and said guide arm comprises holding webs to engage below said transverse-force member to retain it in said cutout in said guide arm.

17. A guide arrangement according to claim 14, wherein said cutout in said guide arm is generally rectangular.

18. A guide arrangement according to claim 15, wherein said cutout in said guide arm has contact faces facing said end faces of said transverse-force member, and said contact faces have a radius of curvature corresponding approximately to the radius of curvature of said end faces of said transverse-force member.

19. A guide arrangement according to claim 14, wherein said cutout in said guide arm opens laterally to the direction of travel of said cutting machine.

* * * * *